US005720047A

United States Patent [19]

Spitzer

[11] Patent Number: 5,720,047

[45] Date of Patent: Feb. 24, 1998

[54] SPORTS GLOVE, IN PARTICULAR A GOALIE GLOVE

[75] Inventor: Thomas Spitzer, Balingen, Germany

[73] Assignee: Uhlsport GmbH, Balingen, Germany

[21] Appl. No.: 743,533

[22] Filed: Nov. 4, 1996

[30] Foreign Application Priority Data

Feb. 5, 1996 [DE] Germany ..... 196 03 997.5
Jun. 15, 1996 [DE] Germany ..... 196 23 928.1

[51] Int. Cl.[6] ..... A41D 19/00
[52] U.S. Cl. ..... 2/161.1; 2/159
[58] Field of Search ..... 2/161.1, 160, 159, 2/167–169

[56] References Cited

U.S. PATENT DOCUMENTS 5,136,725 8/1992 Montero ..... 2/161.1

FOREIGN PATENT DOCUMENTS 77 02 428 5/1977 Germany .
2842720 4/1980 Germany ..... 2/161.1

*Primary Examiner*—Gloria Hale
*Attorney, Agent, or Firm*—Shlesinger Arkwright & Garvey LLP

[57] ABSTRACT

A sports glove, in particular a goalie glove, of which the outside of the palm material preferably is composed of a foamed latex on a textile support material. Additional impact-damping padding is mounted on the inside of the palm material facing the surface of the hand. A so-called spacer fabric designed as a three-dimensional fabric is used as the additional padding and is formed from two flat layers of cover fabrics spaced apart by a sandwiched zone of parallel erect fabric yarns extending perpendicular to the layers of the cover fabrics. In the alternative, an open-pore soft foam or a latex foam of larger thickness and lesser density than the palm material may be used as the additional padding.

14 Claims, 4 Drawing Sheets

SPORTS GLOVE, IN PARTICULAR A GOALIE GLOVE

FIELD OF THE INVENTION

The present invention concerns a sports glove and in particular a glove for a soccer goalie.

The German Gebrauchsmuster 77 02 428 is part of the state of the art.

BACKGROUND OF THE INVENTION

The foremost purpose of a goalie glove when playing soccer is to optimize the goalie's catching effectiveness. Aside from the highest possible friction of the catching surface, the next most essential criterion for optimal catching effectiveness is high damping as the ball impacts against the palm of the glove.

For years, latex foam material has been adopted as the standard surface material for use within the palm of the goalie glove due to the high coefficient of friction relative to the balls' plastic surface as well as its high damping characteristics.

Even though the surface resistance to slippage characteristics of current foamed latex materials has been optimized using special compositions to the point where such materials are considered to be peerless to other materials, the damping characteristics offered by such prior art latex foams remains limited. Although it has been proposed to further improve the catching properties of the goalie glove through selection of a sufficiently large thickness and by adjusting a commensurate compliance of the particular latex foam being used, the end result is a material having a prohibitively lowered lifespan, which also represents the weak point of the goalie gloves used in high-performance sports.

Accordingly, damping of the latex layer forming the palm or catching surface of the goalie glove has not been significantly improved and other prior art approaches have been developed in an effort to achieve the desired result. For example, it has been proposed to place additional damping layers underneath the latex-foam layer of the glove's palm surface. It was found the catching effectiveness rises constantly as the of the damping-layer thickness increases. Simultaneously however, the handling of the glove undesirably decreases as the palm material becomes very thick.

More particularly, very large layer thicknesses of damping material have the following disadvantages. During manufacture, the edges of the inner-layer construction must be sewed to the glove's side pieces and as a result the tensioned seam will compress the damping material. When layers of material are highly compressed, processing on conventional processing machinery is hampered or impossible to achieve. A very thick material hampers manual mobility of the glove. A very thick layer of material degrades wearability and the fit of the goalie glove to the wearers hand, particularly when such layer facing the hand also is stiff. When very thick layers of a damping material are placed underneath the palm material (latex foam) forming the catch surface, the glove may become substantially hermetic at the palm side, leading to strong perspiration and not only to discomfort but also reducing catching effectiveness because with a sweaty hand surface the inside material may slip to and fro on this surface.

It therefore follows that all layers of material covering the palm must mandatorily be open-pored. While the layer of latex foam forming the outer surface of the layer construction always meets this condition, even open-pored foams may hamper vapor dissipation if the layer thickness is unduly large and hence may not allow adequate removal of body moisture during sports activities.

OBJECTS AND SUMMARY OF THE INVENTION

In the light of the above problems, the object of the present invention is to provide an impact-damping substructure for the palm surface of a sports glove and in particular a goalie glove, and in such a manner that for the case of optimal catching effectiveness, neither the processability nor the wearability and adaptation to hand nor the breathing of the glove shall be degraded.

The invention solves this problem by providing a sports glove, in particular a goalie glove, comprising a palm material forming the palm portion of the glove and preferably made of foamed latex on a textile support material, and an additional impact-damping padding mounted on the inside of the palm material facing the surface of the hand and characterized in that a so-called spacer fabric in the form of a three-dimensional fabric is used as the additional padding, the three-dimensional fabric comprising two flat layers of cover fabric which are spaced apart by a sandwiched zone of parallel fabric yarns (erect yarns [23*c*]) running substantially perpendicularly to the layers of cover fabrics.

Alternative embodiments include the use of a polyurethane soft foam for the additional impact damping padding mounted on the inside of the palm material and facing the surface of the hand. In a further alternative embodiment, a latex-foam is used as the padding material.

The materials of the invention used as (additional) impact-damping padding are characterized by the following advantageous properties; (1) comparatively and less in relation to their hardness, they may be compressed to a fraction of their initial thickness,(2) even at maximum compression, they remain fully elastic, and (3) they are highly permeable to water vapor.

As indicated above, so-called spacer fabrics are especially well suited to the purposes of the present invention and are preferred therein. In this embodiment, erect yarns (23*c*) occupy less than 10% of the inside volume of the spacer fabric (20) positioned between the two layers of the cover fabric (21, 22). The pertinent characteristics of this embodiment are a fabric having practically no impedance to diffusion. It is practically 100% air or vapor permeable. When directly mounted on the skin, the fabric of this glove embodiment implements a circulatory air layer providing a most pleasant environment and in this respect a glove that is superior to conventional goalie gloves.

If enough pressure is exerted on the fabric surface, spacer fibers will be tipped parallel to the plane of the fabric surface and as a result, the fabric thickness may be decreased to roughly one tenth the initial height.

Advantageous further developments of the solution of the present invention also include spacer fabrics manufactured in overall thicknesses of a few mm to a few cm. For example, from about 1 cm. to about 3 mm. By varying the material and the yarn thickness, different compressive strengths i.e. hardnesses, may be adjusted independently of thickness.

Synthetic polymer fibers of polyamide, polyester or polypropylene are used conventionally. However composite fabrics may be produced using natural fibers such as of cotton. Due to the particular weaving of such spacer fabrics, both types of fibers need not be present in equal proportions on the two surfaces.

This embodiment is particularly applicable in the case of a mixture of propylene and cotton. Cotton evinces the property of absorbing moisture whereas polypropylene dissipates it. Illustratively according to the present invention, a layer of cover cotton may be mounted on the side away from the skin surface and at least the erect yarns may be made of propylene. The polypropylene fibers wick the moisture away from the body whereas the cotton fabric on the back side will absorb this moisture.

The spacer fabric of the present invention used as the additional padding offers the advantageous property in that it matches itself in an excellent manner to the shape of the users hand. This improves the fit of the glove. Accordingly, the glove volume need not be increased commensurately with the volume of deposited spacer fabric. Instead, the inside volume may be designed in such manner that the contours of the hand partly penetrate the damping padding.

The use of a soft polyurethane foam or a latex foam material for the additional padding in the glove of the present invention will evince substantially the same advantageous properties as provided by the spacer fabric embodiment of the invention.

These and other objects and advantages of the claimed invention will become apparent from the following drawings taken together with the detailed description of the preferred embodiment.

DETAILED DESCRIPTION OF THE INVENTION

Figure 1:
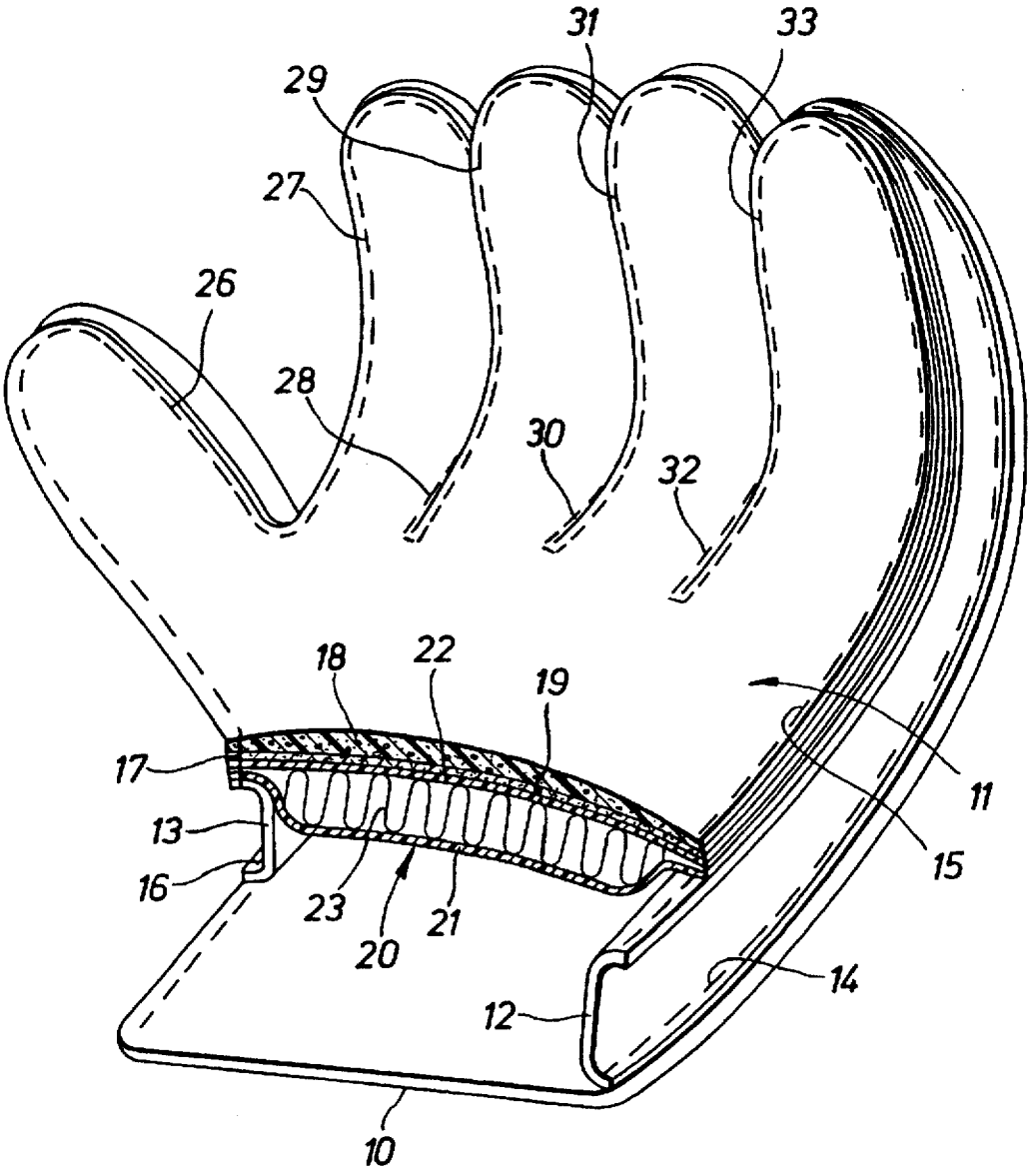
FIG. 1 is a partly cutaway perspective of a goalie glove wherein the palm comprises an additional padding of spacer fabric.

In FIG. 1, 10 denotes the so-called upper hand part i.e. the portion of the glove that faces the back of the users hand while 11 denotes (as a whole) the so-called palm i.e. facing the hand surface of the shown goalie glove. The upper hand part 10 and the palm 11 are joined by side parts 12, 13 to each other. Associated joining seams are denoted by 14 through 17.

The palm denoted as a whole by 11 is composed of several layers. The external surface of the palm 11 (which is directly in contact with a ball to be caught) is composed of a foamed-latex layer 18 firmly affixed to a textile support material 19 made of, for example, cotton material and as will be further discussed below. These two joined layers 18, 19 are typically called the "palm" of the goalie glove.

A third layer 20 denoted as a whole and in the form of a spacer fabric is present inside the palm layers 18, 19 and acts as an impact-damping padding in addition to the limited damping action already provided by the latex layer 18. Spacer fabric 20 is composed of two layers of covering fabric 21, 22 which are spaced apart by fabric yarns 23 running substantially perpendicular to the layers of covering fabric 21, 22.

Figure 4:
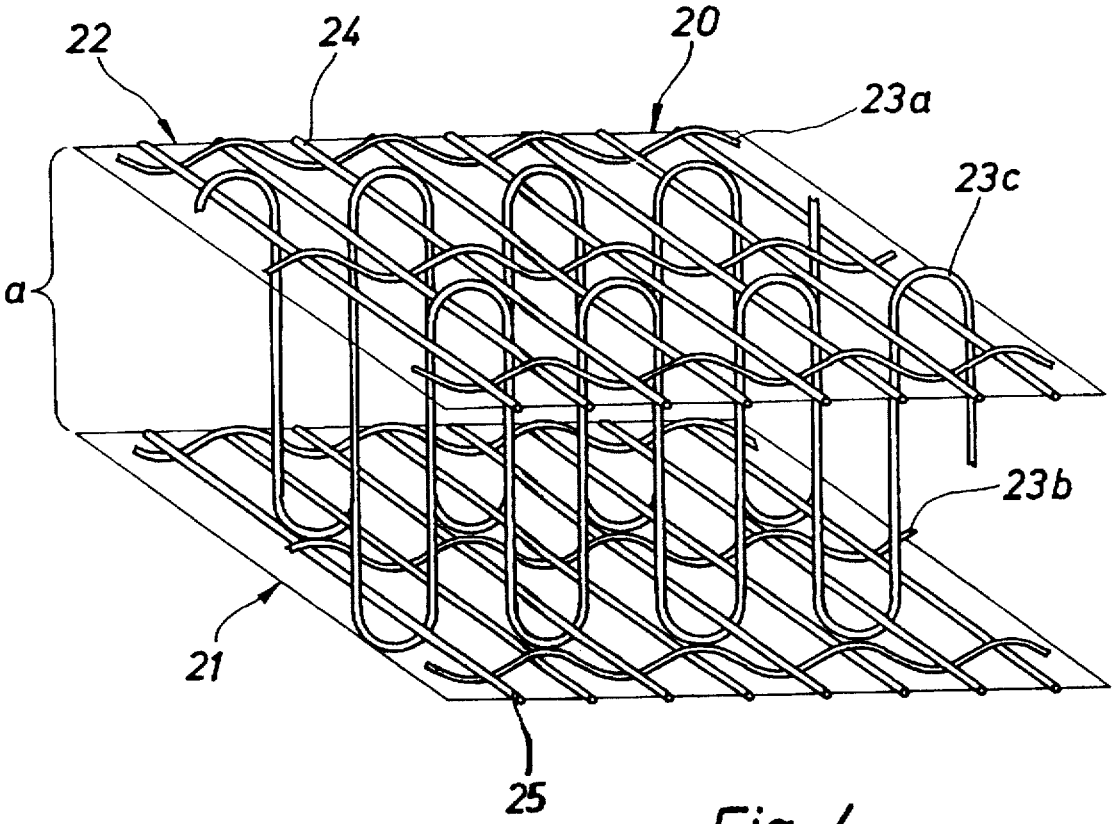
FIG. 4 is a schematic and enlarged perspective of a spacer fabric illustrating the special weave used therein.

A three-dimensional fabric such as spacer fabric 20 assumes very special weaving technology as is best shown schematically in FIG. 4. As earlier noted, the two cover layers are denoted by 21 and 22. These layers are based upon two rows of parallel longitudinal yarns 24 and 25, the so-called "fillings", that are spaced apart the distance "a", and which are interlaced in the manner shown with cross yarns **23*a* and 23*b*, the so-called "warps" and with the erect yarns 23*c*. The perpendicularly erect yarns 23*c* are woven between the planes of the warps 23*a* and 23*b* and in a manner such that they loop around the fillings 24 and 25 of both cover layers 21 and 22 and in their unloaded state function to keep the two cover layers 21 and 22** positioned apart the distance "a".

Heretofore known commercial spacer fabrics consist of a uniform material, namely polyamide. In that case a distinction between the warps **23*a* and 23*b* would be superfluous (FIG. 4) and all warps, as shown in FIG. 1, would then be merely denoted by 23**. Such a commercial spacer fabric is wholly applicable to the purposes of the present invention.

However attention should be paid that the (inside) layer of cover fabric 21 represents a glove surface which comes into contact directly with the omitted surface of the hand. In this case the (inside) layer of cover fabric 21 appropriately is composed of a skin-compatible material.

Regarding the upper or outer cover layer 22, preferably it shall be composed of cotton so that the moisture or sweat separated from the surface of the hand shall be stored away from it. Since cotton has the known property of absorbing perspiration, sweat forming at the hand surface will be rapidly absorbed by it.

The above embodiment is based on the concept that moisture which accumulates from the perspiration cannot immediately be dissipated into the ambient air. Therefore the residual moisture in the glove is advantageously stored away from the skin. In order to move the moisture as rapidly as possible away from the skin surface, the erect yarns **23*c*** should be made of propylene.

Accordingly, the above described properties and functions can be individually implemented in an economical manner by a composite weave of the spacer fabric 20 as shown in FIG. 4 and in such manner that its side away from the hand surface i.e. the outer layer of covering fabric 22, is composed at least predominantly of cotton fibers while the other side facing the hand surface i.e. the inside layer of covering fabric 21, is composed at least predominantly of synthetic polyamide fibers, for instance of polyamide or preferably of polypropylene. As an alternative to polypropylene or polyamide, polyester also may be used.

Sewing the spacer fabric 20 at side edges 15 and 17 to the palm 18 and 19 of the goalie glove of FIG. 1 will only take place when the entire laminated palm construction is stitched together with the intermediate pieces and side pieces of the fingers and as shown by seams 14 through 17 and seams 26 through 33.

Appropriately, the latex palm 18 and 19 shall be manufactured in such a manner that the foamed material forming the layer 18 is deposited in liquid form onto the textile support material 19 using for example a doctor blade. In such cases, the spacer fabric 20 acting as additional padding will advantageously be prefabricated in the form of a roll-fed material. The spacer fabric 20 may then be bonded, by sandwiching a layer of MOLTOPRENE (a polyurethane foam), which functions as a hot-melt adhesive for the cotton fabric support of the palm material. If a skin-compatible textile layer facing the hand is provided, for example when the entire spacer fabric 20 is uniformly composed of polymer fibers, for example polyamide fibers, the skin-compatible textile layer will also be appropriately bonded by flame bonding.

In a second embodiment of the invention, the cotton fabric support 19 of palm material 18 and 19 is first laminated onto the prefabricated damping material i.e. spacer material 20. This roll-fed laminated material is then coated with latex foam. Thereby the entire palm 11, following doctoring and vulcanizing of the latex layer 18, will have been manufactured.

Using a suitable damper padding material, for instance a cotton/polypropylene spacer fabric 20 of appropriate mesh width, the liquid latex forming the layer 18 also may be doctored directly. The latex should be deposited on the cotton side of the spacer fabric 20 which should be pretreated for good adhesion of the latex foam.

Figure 2:
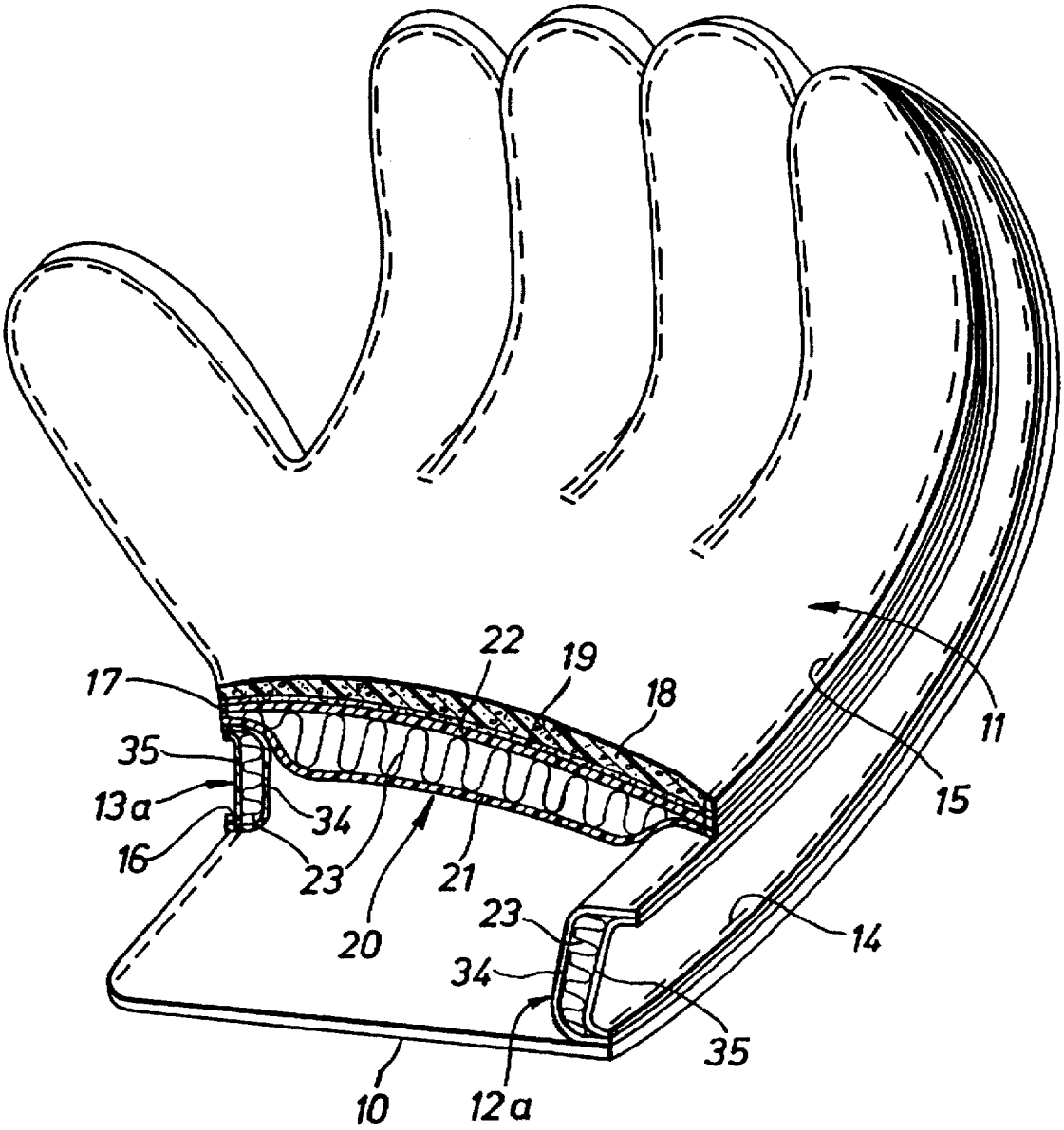
FIG. 2 is a view similar to FIG. 1 but of variation of a goalie glove for which the side parts also are composed of spacer fabrics.

The embodiment of FIG. 2 evinces the feature that the two side parts of the goalie glove which in this embodiment contrary to the case of FIG. 1 are denoted by 12*a* and 13*a* and are composed of spacer material. In this embodiment, the two cover layers are denoted by 34 and 35 respectively. Regarding the detailed construction of the two side parts 12*a* and 13*a*, the particulars listed in relation to FIG. 1 and to FIG. 4 and concerning the spacer material 20 apply correspondingly. However, a modified i.e. thinner, thicker, softer or more rigid, fabric than that described regarding spacer fabric 20 may be used for the side spacer fabrics 12*a* and 13*a*.

The embodiment of FIG. 2 may also be designed in such a manner that the side parts of the fingers not shown in FIG. 2 i.e. the so-called finger median pieces, are composed in whole or in part of spacer material.

For purposes of clarity, the reference numbers in the embodiment of FIG. 2 correspond to those of FIG. 1. The special advantages of the embodiment of FIG. 2 are as follows. The hand is ventilated unusually well. Accordingly, hand sweating is widely precluded. The padding component of the spacer fabric in the glove's side part 12*a* and which is present near the little finger provides added protection when the hand impacts the ground or an opposing player.

Figure 3:
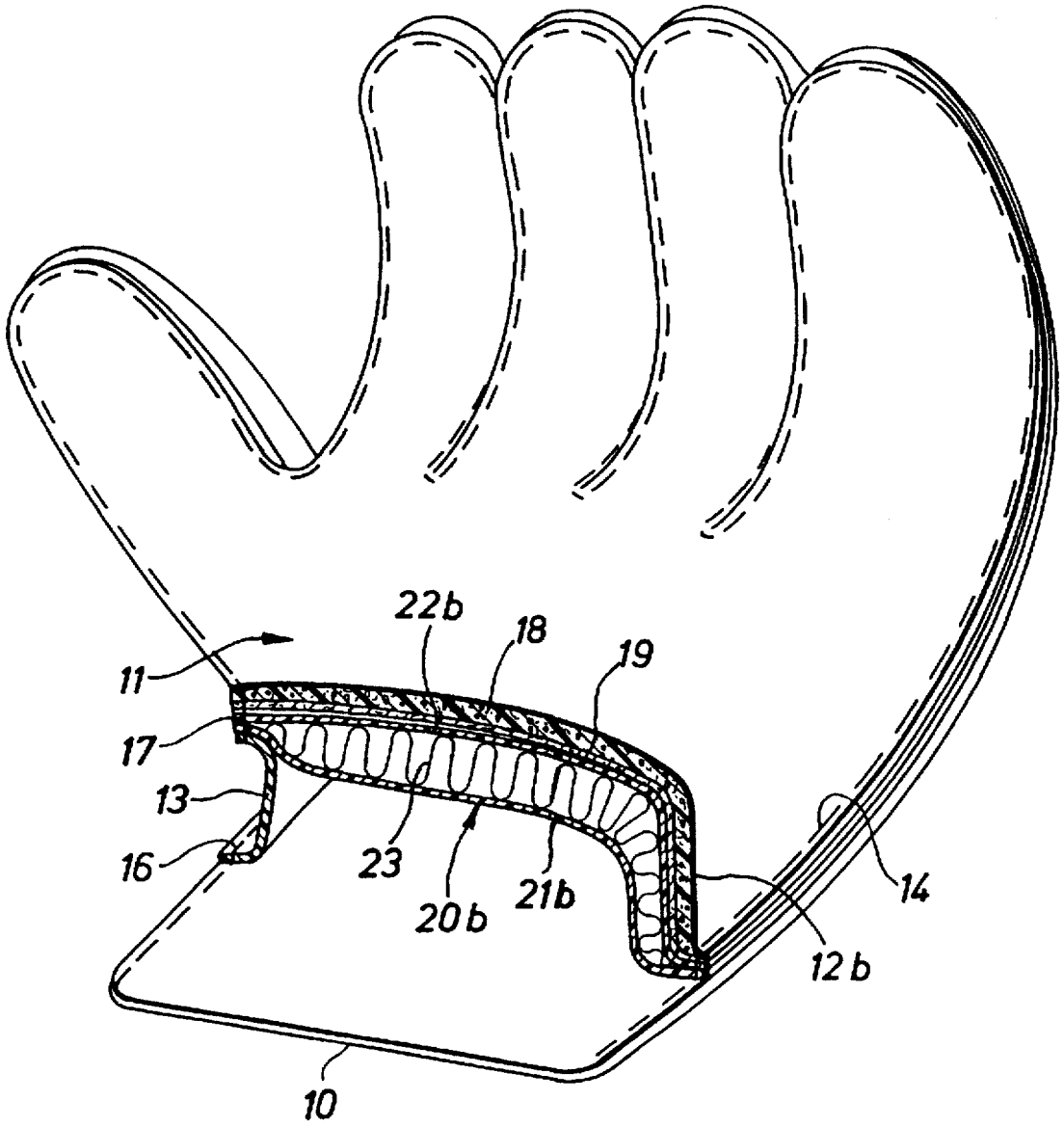
FIG. 3 is a view similar to those of FIGS. 1 and 2 of a further variation wherein a side part of the goalie glove is integral with the palm.

FIG. 3 shows a further embodiment of the goalie glove of the present invention. In this embodiment one of the two side parts, namely the side part positioned at the hand's outer edge and denoted by 12*b* is integral with the palm 11. The additional padding denoted by 20*b* and in the form of a spacer fabric also runs into the zone of side part 12*b*. Stitching is required on this side only at 14 and to the upper hand part 10. This embodiment provides the advantage, similar to that of the embodiment in FIG. 2, of added impact protection for the outer hand edge.

The other side part 13 located on the palm edge evinces the same design and is stitched at 16 and 17 as in the FIG. 1 embodiment. However, the side part 13 may be made integral with the palm part 11 and additionally provide a pad for the area in a corresponding manner using the spacer fabric 20*b*. In that case and similarly to the outer side part 12*b*, this spacer fabric 20*b* should be run at a right angle as far as the upper hand part and be stitched to this upper hand part only at 16.

As set forth earlier, the finger side parts i.e. the finger median pieces, may be made integral with the palm part 11 and may also be additionally padded with a spacer fabric or soft foam.

For purposes of clarity, the reference numbers in FIG. 3 correspond to the same components found in FIGS. 1 and 2; and, where particular features are involved, include the suffix "b" for further clarity between each of the embodiments of FIGS. 1, 2 and 3.

In lieu of the spacer fabric 20, 12*a*, 13*a*, 13*b* used in the embodiments of FIGS. 1, 2 and 3, a suitable open-pore soft foam also may be used as additional padding.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A sports glove comprising a palm material (18, 19) forming a glove palm (11), said palm material is a foamed latex (18) on a textile support material (19) and having an additional, impact-damping padding (20) mounted thereto and positioned so as to face the surface of the users hand, said additional padding comprising:

a) a three-dimensional spacer fabric (20), said three-dimensional spacer fabric comprising at least two, superimposed, flat layers of cover fabric (21, 22), said flat layers of cover fabric disposed in a spaced relation from each other by a zone of parallel erect yarns (23*c*) extending substantially perpendicular to the layers of said cover fabrics (21, 22) and sandwiched therebetween.

2. A sports glove as set forth in claim 1 and wherein:

a) said additional padding forms a contact surface against the hand of the user.

3. A sports glove as set forth in claim 1 and wherein:

a) said spacer fabric (20) has a thickness of about 3 mm to about 1 cm.

4. A sports glove as set forth in claim 1 and wherein:

a) said spacer fabric (20) is selected from the group of synthetic materials consisting of polyamide, polyester and polypropylene.

5. A sports glove as set forth in claim 4 and wherein:

a) said spacer fabric (20) is a composite fabric including natural cotton fibers.

6. A sports glove as set forth in claim 5 and wherein:

a) one of said at least two layers of cover fabric is formed predominantly from cotton fibers while the other of said at least two layers of cover fabric is formed predominantly from polypropylene fibers.

7. A sports glove as set forth in claim 6 and wherein:

a) said polypropylene cover fabric faces the surface of the users hand and said cotton cover fabric faces said palm material.

8. A sports glove as set forth in claim 4 and wherein:

a) said palm material including a cotton fabric support layer upon which said foamed latex is supported, said impact damping padding is flame-bonded to said cotton fabric support layer with a layer of moltopreme hot-melt adhesive sandwiched therebetween.

9. A sports glove as set forth in claim 8 and further comprising:

a) a skin-compatible layer of textile material flame-bonded to the side of the additional padding (20) facing the users hand.

10. A sports glove as set forth in claim 4 and wherein:

a) said palm material including a cotton fabric support layer upon which said foamed latex is supported, said impact damping padding is laminated to said cotton fabric support layer.

11. A sports glove as set forth in claim 10 and wherein:

a) said latex material (18) forming said palm (18, 19) is doctor-deposited directly onto said spacer fabric containing said cotton fibers.

12. A sports glove as set forth in claim 1 and further including:

a) side walls (12*a*, 13*a*) extending between said glove palm (11) and an upper hand part (10) and connected thereto, said side walls including a spacer fabric of open-pore soft foam material.

13. A sports glove as set forth in claim 1 and further including:

a) side walls (12*a*, 13*a*) extending between said glove palm (11) and an upper hand part (10) and, b) finger portions for receiving the fingers of a user, wherein at least one of said side walls or at least one of said finger portions are integral with said palm (11) and at least a side part (12*b*) present against the outer edge of the hand or at least one of said finger portions comprising an additional spacer fabric padding of open-pore soft foam material.

14. A sports glove comprising a palm material forming a glove palm, said palm material is a foamed latex on a textile support material and having an additional, impact-dampening padding mounted thereto and positioned so as to face the surface of the user's hand, said additional padding comprising:

a) a three-dimensional spacer fabric, said three-dimensional spacer fabric comprising at least two, superimposed, flat layers of cover fabric, said flat layers of cover fabric disposed in a spaced relation from each other by parallel erect yarns forming a zone having an inside volume extending substantially between said flat layers of cover fabric, said parallel erect yarns extending substantially perpendicular to the layers of said cover fabrics and sandwiched therebetween; and, b) said parallel erect yarns occupy less than 10% of said inside volume of said zone of parallel erect yarns.

* * * * *